US010259027B2

(12) United States Patent
Ueno et al.

(10) Patent No.: US 10,259,027 B2
(45) Date of Patent: Apr. 16, 2019

(54) COLD ROLLING FACILITY AND COLD ROLLING METHOD

(71) Applicant: JFE STEEL CORPORATION, Tokyo (JP)

(72) Inventors: Masayasu Ueno, Tokyo (JP); Yoshimitsu Harada, Tokyo (JP); Hidemasa Kodama, Tokyo (JP); Tatsuhito Fukushima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 138 days.

(21) Appl. No.: 15/114,540

(22) PCT Filed: Jan. 9, 2015

(86) PCT No.: PCT/JP2015/050533

§ 371 (c)(1),
(2) Date: Jul. 27, 2016

(87) PCT Pub. No.: WO2015/115156

PCT Pub. Date: Aug. 6, 2015

(65) Prior Publication Data

US 2016/0339493 A1 Nov. 24, 2016

(30) Foreign Application Priority Data

Jan. 29, 2014 (JP) ..... 2014-014646

(51) Int. Cl.
*B21B 37/68* (2006.01)
*B21C 51/00* (2006.01)
(Continued)

(52) U.S. Cl.
CPC ..... *B21B 37/68* (2013.01); *B21C 51/00* (2013.01); *B21B 37/58* (2013.01); *B21B 37/74* (2013.01);
(Continued)

(58) Field of Classification Search
CPC ..... B21B 37/68; B21B 37/74; B21B 38/04; B21B 39/082; B21B 45/004
See application file for complete search history.

(56) References Cited

U.S. PATENT DOCUMENTS 4,179,913 A * 12/1979 Martt ..... B21B 15/0085 72/251
2012/0000213 A1* 1/2012 Lin ..... B21B 37/74 62/64
2014/0007637 A1 1/2014 Hayashi et al.

FOREIGN PATENT DOCUMENTS

CN 1718298 A 1/2006
CN 102612414 7/2012
(Continued)

OTHER PUBLICATIONS

JPO translation of JP 2002059208 A; Apr. 2018.*
(Continued)

*Primary Examiner* — Pradeep C Battula
(74) *Attorney, Agent, or Firm* — RatnerPrestia

(57) ABSTRACT

A cold rolling facility includes: a heating device; a tandem mill including a plurality of rolling mills; a meandering-amount measuring unit; a meandering-movement correction device; a shape measuring unit; a shape controller configured to control a shape of a steel sheet after being cold-rolled by the rolling mill located on the uppermost stream side; and a controller configured to control operations of the meandering-movement correction device based on a measurement value of a meandering-movement amount of the steel sheet by the meandering-amount measuring unit to control a meandering movement of the steel sheet before being heated, and configured to control operations of the shape controller based on a measurement value of a shape of the steel sheet by the shape measuring unit to control the meandering movement of the steel sheet that is attributed to cold rolling of the steel sheet by the tandem mill.

4 Claims, 4 Drawing Sheets

(51) Int. Cl.

| | |
|---|---|
| *B21B 38/02* | (2006.01) |
| *B21B 37/58* | (2006.01) |
| *B21B 37/74* | (2006.01) |
| *B21B 38/04* | (2006.01) |
| *B21B 39/08* | (2006.01) |
| *B21B 45/00* | (2006.01) |

(52) U.S. Cl.

CPC ..... *B21B 38/02* (2013.01); *B21B 38/04* (2013.01); *B21B 39/082* (2013.01); *B21B 45/004* (2013.01); *B21B 2271/02* (2013.01); *B21B 2273/04* (2013.01)

(56) References Cited

FOREIGN PATENT DOCUMENTS

| | | | | |
|---|---|---|---|---|
| CN | 103269810 | A | | 8/2013 |
| EP | 2500114 | | | 9/2012 |
| JP | S53070063 | | | 6/1978 |
| JP | 61015919 | | | 1/1986 |
| JP | S6310005 | A | | 1/1988 |
| JP | S6320116 | A | | 1/1988 |
| JP | 63183713 | A | | 7/1988 |
| JP | H0284216 | A | | 3/1990 |
| JP | 0565247 | B2 | | 9/1993 |
| JP | 0716683 | B2 | | 3/1995 |
| JP | 2751403 | B2 | | 2/1998 |
| JP | 11172325 | | | 6/1999 |
| JP | 11290931 | | | 10/1999 |
| JP | 2002059208 | A | * | 2/2002 |
| JP | 2003275811 | | | 9/2003 |
| JP | 2004243376 | A | | 9/2004 |
| JP | 2006346715 | | | 12/2006 |
| JP | 2007007754 | | | 1/2007 |
| JP | 2011224594 | A | * | 11/2011 |
| JP | 2012148310 | | | 8/2012 |

OTHER PUBLICATIONS

JPO translation of JP 2011224594 A; Apr. 2018.*

Taiwanese Office Action dated Nov. 11, 2016 for Taiwanese Application No. 104101764, including Concise Statement of Search Report, 8 pages.

Korean Office Action with English language translation for Application No. 10-2016-7019943, 9 pages.

Supplementary European Search Report for Application No. 15743926.6, dated Aug. 22, 2017, 8 pages.

International Search Report and Written Opinion for International Application PCT/JP2015/050533, dated Mar. 10, 2015, 5 pages.

Notification of Reasons for Refusal for Japanese Application No. 2014014646, dated Jun. 2, 2016 with translation, 6 pages.

Chinese Office Action and Search Report with partial English language translation for Application No. 201580006264, dated Mar. 17, 2017, 9 pages.

* cited by examiner

COLD ROLLING FACILITY AND COLD ROLLING METHOD

CROSS-REFERENCE TO RELATED APPLICATIONS

This is the U.S. National Phase application of PCT International Application No. PCT/JP2015/050533, filed Jan. 9, 2015, and claims priority to Japanese Patent Application No. 2014-014646, filed Jan. 29, 2014, the disclosures of these applications being incorporated herein by reference in their entireties for all purposes.

FIELD OF THE INVENTION

The present invention relates to a cold rolling facility that cold-rolls a steel sheet and a cold-rolling method of cold-rolling the steel sheet.

BACKGROUND OF THE INVENTION

In the past, in a cold rolling operation of a steel sheet, regardless of a cold rolling facility, such as a completely continuous cold tandem mill, a continuous tandem mill arranged subsequently to a pickling line, or a single-stand reverse mill, the steel sheet heated to a level of room temperature that is at most 40° C. is cold-rolled. This is because, even after considering that the deformation resistance of the steel sheet lowers along with the increase of a steel-sheet temperature, a demerit becomes large compared with a merit obtained by increasing the temperature of the steel sheet that is a material to be rolled. For example, as a merit obtained by increasing the temperature of the steel sheet, the decrease of the rolling power along with the decrease of the deformation resistance of the steel sheet can be designated. However, in the cold rolling operation of the steel sheet, this merit can be almost disregarded. On the other hand, there exists a large demerit attributed to the temperature increases of the steel sheet, such as the extremely large cost loss for increasing a steel-sheet temperature, or the handling problem of a hot steel sheet with respect to a labor environment.

When the steel sheet heated to a level of room temperature is cold-rolled as mentioned above, there exists the possibility that edge cracks occur in an end portion (hereinafter, referred to as "edge portion") in the width direction of the steel sheet in the process of cold rolling. Particularly, a material difficult to be rolled, such as a silicon steel sheet containing 1% or more of silicon, a stainless steel sheet, or a high carbon steel sheet, is a brittle material as compared with a general steel sheet and hence, when the material difficult to be rolled is heated to a level of room temperature and cold-rolled, the edge cracks remarkably occur. When the extent of the edge crack is large, there exists the possibility that the steel sheet is broken from the edge crack as a starting point in the process of cold rolling.

As a method of overcoming such problems, for example, Patent Literature 1 discloses a method for cold-rolling a silicon steel sheet in which the silicon steel sheet at its edge portion heated to 60° C. or higher (ductile brittle transition temperature) is, in cold-rolling the silicon steel sheet, supplied to a rolling mill as a material to be rolled. Furthermore, Patent Literature 2 discloses a pair of induction heating devices each using a C-shaped inductor (heating inductor) as a means for increasing the temperature of an edge portion of a steel sheet by induction heating. The induction heating device described in Patent Literature 2 is constituted such that each of both the edge portions of the steel sheet in the width direction (hereinafter, referred properly to as "sheet width direction") are inserted into a slit of the C-shaped inductor in a vertically sandwiched and spaced apart manner, a high frequency current is sent to the coil of the C-shaped inductor from a power unit to apply magnetic fluxes to the edge portions in the thickness direction of the steel sheet (hereinafter, referred properly to "sheet thickness direction") and generate an induced current in the edge portions, and the edge portions are heated with the Joule heat that occurs by the induced current.

Here, in order to heat the edge portion of the steel sheet to a predetermined temperature, it is necessary that the length of the edge portion of the steel sheet overlapping with the C-shaped inductor whose slit inserts the edge portion thereinto in a vertically sandwiched and spaced apart manner in the sheet thickness direction (hereinafter, referred to as "overlapping length") assume a predetermined value by setting the position of a carriage that supports the C-shaped inductor depending on the sheet width of the steel sheet. However, in an actual operation, a steel sheet moves in a meandering manner in the sheet width direction by a poor centering accuracy or a poor flatness of the steel sheet thus changing the overlapping length. When the overlapping length decreases, the occurrence of an eddy current that obstructs the flow of the magnetic flux decreases and hence, even when a power factor deteriorates to increase a wattless current and a high frequency current that flows into the coil of the C-shaped inductor increases to a rated value, it is impossible to achieve a predetermined output. As a result, there exists the possibility that the underheat of the edge portion occurs. There also exists the possibility that the situation of excessively heating a part of the edge portion (abnormal local heating) arises.

In the case of the underheat, edge cracks occur in the edge portion while cold-rolling the steel sheet. The edge cracks cause the fracture of the steel sheet in the process of cold rolling as described above. On the other hand, in the case of the abnormal local heating, edge waves attributed to a deformation by a thermal stress occur in the edge portion of the steel sheet. When the extent of the edge wave is large, there exists the possibility that a drawing fracture occurs in the steel sheet in the process of cold rolling and hence, it is difficult to cold-roll the steel sheet stably. In this manner, when the edge portion of the steel sheet to be cold-rolled is heated to a predetermined temperature by induction heating, it is extremely important to control the overlapping length to an optimal value.

Here, as a conventional technique with respect to the control of the overlapping length mentioned above, for example, there is disclosed an induction heating device provided with a heating coil that heats edge portion of a steel sheet transferred, a coil carriage body on which the heating coil is mounted, a movement mechanism that moves the coil carriage body in the direction orthogonal to the movement direction of the steel sheet, and guide rollers that are attached to the coil carriage body and brought into contact with the edge portion of the steel sheet (refer to Patent Literature 3). The induction heating device described in Patent Literature 3 operates the movement mechanism so that the guide rollers are brought into contact with the edge portion of the steel sheet while induction-heating the steel sheet, and always keeps the relative position relation between the steel sheet and the heating coil constant.

Furthermore, there is disclosed a method of induction-heating control in which carriages each of which moves in the direction orthogonal to the movement direction of the steel sheet are located at the respective left-and-right side positions of the line through which the left-and-right edge portions of the steel sheet pass, inductors each of which inserts the edge portion of the steel sheet thereinto in a vertically sandwiched manner are arranged on the respective carriages located at left-and-right positions, and an automatic position controller of the carriage controls the overlapping length between the edge portion of the steel sheet and the inductor to heat the edge portion of the steel sheet (refer to Patent Literature 4). In the method of induction-heating control described in Patent Literature 4, the high frequency current that flows into the heating coil of each of the inductors located at left-and-right positions is detected, the deviation of an electric current value that is generated by the change of the overlapping length due to the meandering movement of the steel sheet is obtained, and a carriage position correction value is obtained based on a relation between a deviation electric current value stored in advance and a carriage position correction amount of the inductor that is required to set the deviation electric current value to zero. Subsequently, the carriage position correction value is subtracted from a carriage position initialized value on the large electric current value side of the carriage and, at the same time, the carriage position correction value is added to a carriage position initialized value on the small electric current value side of the carriage to obtain a carriage correction position on either side. Thereafter, the carriage correction position on the either side that is calculated as mentioned above is output to the automatic position controller of each carriage on either side and hence, the position of each carriage on the either side is corrected by the automatic position controller. Due to such a constitution, the overlapping length between each of the left-and-right edge portions of the steel sheet and each inductor on either side is controlled.

CITATION LIST

Patent Literature

Patent Literature 1: Japanese Patent Application Laid-open No. 61-15919

Patent Literature 2: Japanese Patent Application Laid-open No. 11-290931

Patent Literature 3: Japanese Patent Application Laid-open No. 53-70063

Patent Literature 4: Japanese Patent Application Laid-open No. 11-172325

SUMMARY OF THE INVENTION

In the conventional techniques mentioned above, the overlapping length between the edge portion of the steel sheet and the inductor of the induction heating device is corrected depending on a position change of the edge portion that is attributed to the meandering movement of the steel sheet. That is, a feedback control that corrects the overlapping length depending on the position change of the edge portion is conventionally performed. However, a meandering movement speed of the steel sheet is comparatively higher than the travelling speed of the carriage that mounts the inductor thereon and hence, in the conventional techniques mentioned above, it is difficult to adapt sufficiently the feedback control of the overlapping length to the position change of the edge portion that is attributed to the meandering movement of the steel sheet. Accordingly, in heating the edge portion of the steel sheet before being cold-rolled to a predetermined temperature by induction heating, it is extremely difficult to control stably the overlapping length to an optimal value. As a result, in the steel sheet as a material to be rolled, the underheat or abnormal local heating of the edge portion occurs. When the steel sheet is cold-rolled in this state, the fracture of the steel sheet occurs due to the edge cracks generated by the underheat of the edge portion, or the drawing fracture of the steel sheet occurs due to the edge wave generated by the abnormal local heating of the edge portion. The occurrence of the fracture attributed to the edge cracks of the steel sheet or the drawing fracture attributed to the edge wave (hereinafter, referred collectively to as "steel-sheet fracture", as needed) inhibits the cold rolling operation of the steel sheet and results in lower cold rolling production efficiency.

The present invention has been made under such circumstances, and it is an object of the present invention to provide a cold rolling facility and a method for cold rolling that are capable of suppressing the occurrence of a steel-sheet fracture as much as possible to achieve stable cold rolling of a steel sheet.

To solve the above-described problem and achieve the object, a cold rolling facility according to an embodiment of the present invention, in which a heating device heats sequentially-transferred steel sheets, and a tandem mill including a plurality of rolling mills aligned in a transfer direction of the steel sheets sequentially cold-rolls the heated steel sheets, includes: a meandering-amount measuring unit configured to measure a meandering amount of each of the steel sheets before being heated by the heating device; a meandering-movement correction device configured to correct meandering movement of the steel sheet before being heated; a shape measuring unit configured to measure the shape of the steel sheet after being cold-rolled by the rolling mill located on an uppermost stream side in the tandem mill; a shape controller configured to control the shape of the steel sheet after being cold-rolled by the rolling mill located on the uppermost stream side; and a controller configured to control operations of the meandering-movement correction device based on a measurement value of the meandering-movement amount of the steel sheet by the meandering-amount measuring unit to control the meandering movement of the steel sheet before being heated, and configured to control operations of the shape controller based on the measurement value of the shape of the steel sheet by the shape measuring unit to control the meandering movement of the steel sheet that is attributed to cold rolling of the steel sheet by the tandem mill.

Moreover, in the above-described cold rolling facility according to an embodiment of the present invention, the meandering-movement correction device is located on the upstream side of the heating device in the transfer direction of the steel sheets, and the meandering-amount measuring unit is located between the meandering-movement correction device and the heating device.

Moreover, in the above-described cold rolling facility according to an embodiment of the present invention, the heating device includes C-shaped inductors each of which inserts thereinto respective edge portions in a width direction of the steel sheet in a sandwiched and spaced apart manner in a thickness direction of the steel sheet, and the heating device heats both the edge portions of the steel sheet by induction heating.

Moreover, a cold rolling method, according to an embodiment of the present invention, of heating sequentially-transferred steel sheets by a heating device, and sequentially cold-rolling the heated steel sheets by a tandem mill including a plurality of rolling mills aligned in a transfer direction of the steel sheets includes: measuring a meandering-movement amount of each of the steel sheets before being heated by the heating device, and the shape of the steel sheet after being cold-rolled by the rolling mill located on an uppermost stream side in the tandem mill; and controlling meandering movement of the steel sheet before being heated based on a measurement value of the meandering-movement amount of the steel sheet, and controlling meandering movement attributed to cold rolling of the steel sheet based on the measurement value of the shape of the steel sheet.

Moreover, in the above-described cold rolling method according to an embodiment of the present invention, the measuring measures the meandering-movement amount of the steel sheet before being heated, by a meandering-movement amount measuring unit arranged between the heating device and a meandering-movement correction device that is arranged on the upstream side of the heating device in the transfer direction of the steel sheet and corrects the meandering movement of the steel sheet before being heated.

Moreover, the above-described cold rolling method according to an embodiment of the present invention further includes heating, by induction heating, both edge portions of the steel sheet in a width direction of the steel sheet whose meandering movement is controlled at the controlling, by using the heating device provided with C-shaped inductors each of which inserts thereinto the respective edge portions of the steel sheet in a width direction of the steel sheet in a sandwiched and spaced apart manner in a thickness direction of the steel sheet.

According to the present invention, it is possible to achieve advantageous effects that suppress the occurrence of a steel-sheet fracture as much as possible, and enable stable cold rolling of a steel sheet.

DETAILED DESCRIPTION OF EMBODIMENTS OF THE INVENTION

Hereinafter, the explanation is, in reference to attached drawings, specifically made with respect to a preferred embodiment of a cold rolling facility and a method for cold rolling according to the present invention. Here, the present invention is not limited to the present embodiment.

Cold Rolling Facility

Figure 1:
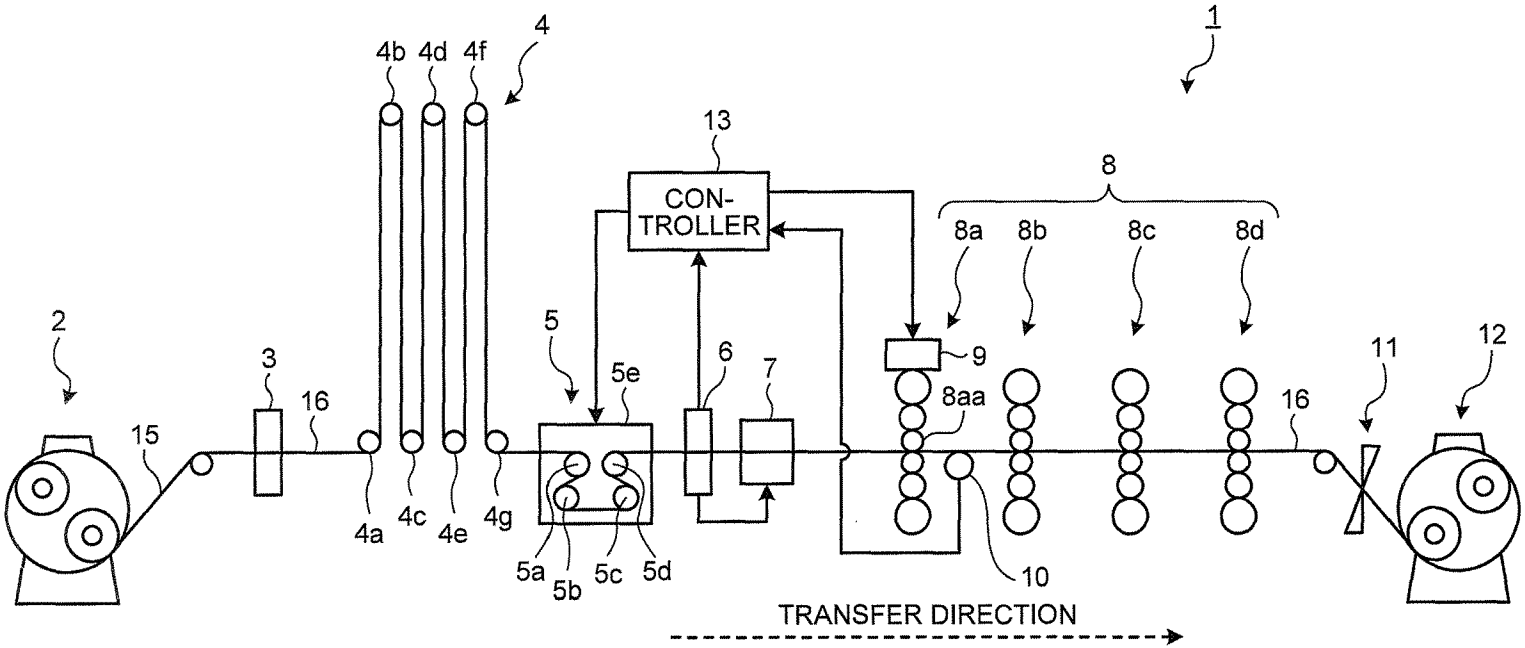
FIG. 1 is a view illustrating one configuration example of a cold rolling facility according to an embodiment of the present invention.

First of all, the cold rolling facility according to the embodiment of the present invention is explained. FIG. 1 is a view illustrating one configuration example of the cold rolling facility according to the embodiment of the present invention. As illustrated in FIG. 1, a cold rolling facility 1 according to the present embodiment is provided with an uncoiler 2 and a tension reel 12 that are arranged on an entrance end and an exit end of a transfer passage for a material to be rolled, respectively. Furthermore, the cold rolling facility 1 is provided with a welding machine 3, a looper 4, a meandering-movement correction device 5, a sheet width meter 6, a heating device 7, a tandem mill 8 and a shape measuring unit 10, and a flying shear 11, along the transfer passage of the material to be rolled between the uncoiler 2 and the tension reel 12. A rolling mill 8*a* arranged on the uppermost stream side of the tandem mill 8 is provided with a shape control actuator 9. Furthermore, the cold rolling facility 1 is provided with a controller 13 that controls the meandering-movement correction device 5 and the shape control actuator 9.

The uncoiler 2 takes steel sheets 15 from a coil formed by winding steel materials, such as hot rolled steel sheets, by uncoiling the coil to supply the steel sheets 15 sequentially to the transfer passage of a material to be rolled in the cold rolling facility 1. The steel sheets 15 taken from the uncoiler 2 pass through a pinch roll or the like to be transferred sequentially to the welding machine 3 located on the downstream side of the uncoiler 2 in the transfer direction of the steel sheets 15.

The welding machine 3 is constituted of a laser beam welding machine or the like and, as illustrated in FIG. 1, arranged between the uncoiler 2 and the looper 4 in the vicinity of the transfer passage of the material to be rolled. The welding machine 3 receives sequentially the plurality of steel sheets 15 supplied from the uncoiler 2, and welds the tail end portion of the steel sheet preceding in the transfer direction out of the steel sheets 15 (hereinafter, referred to as "preceding material") and the distal end portion of the steel sheet succeeding the precedent material (hereinafter, referred to as "succeeding material"). The welding machine 3 performs sequentially welding processing with respect to the steel sheets 15 supplied from the uncoiler 2; that is, the welding machine 3 welds sequentially the tail end portion of the preceding material and the distal end portion of the succeeding material as mentioned above thus forming a steel strip 16 produced by joining the distal end portion and the tail end portion of the respective steel sheets 15. The steel strip 16 is taken out from the welding machine 3 and thereafter, transferred sequentially to the looper 4 located on the downstream side of the welding machine 3 in the transfer direction of the steel strip 16.

The looper 4 is a device for accumulating or supplying properly the steel strip 16 to which continuous processing, such as cold rolling, is applied. To be more specific, as illustrated in FIG. 1, the looper 4 is provided with a plurality of fixed rolls 4*a*, 4*c*, 4*e*, and 4*g*and a plurality of movable rolls 4*b*, 4*d*, and 4*f* movable in the direction toward or away from the fixed rolls 4*a*, 4*c*, 4*e*, and 4*g*. In such a looper 4, as illustrated in FIG. 1, the fixed roll 4*a*, the movable roll 4*b*, the fixed roll 4*c*, the movable roll 4*d*, the fixed roll 4*e*, the movable roll 4*f*, and the fixed roll 4*g* are arranged along the transfer passage of the steel strip 16 in the order given above.

The fixed rolls 4*a*, 4*c*, 4*e*, and 4*g* each of which is a transfer roll located at a fixed position are, as illustrated in FIG. 1 for example, arranged so as to be aligned in the direction toward the meandering-movement correction device 5 from the welding machine 3. The fixed rolls 4*a*, 4*c*, 4*e*, and 4*g* are brought into contact with the steel strip 16 extended therealong and wrapped therearound.

In this state, each fixed roll rotates about the roll center axis thereof as a center by the operation of a drive unit (not illustrated in the drawings). Accordingly, each of the fixed rolls 4*a*, 4*c*, 4*e*, and 4*g* transfers the steel strip 16 along the transfer passage of the steel strip 16 and, at the same time, applies a tensile force to the steel strip 16 at a fixed position.

On the other hand, each of the movable rolls 4*b*, 4*d*, and 4*f* is a transfer roll movable in the direction toward or away from the fixed rolls 4*a*, 4*c*, 4*e*, and 4*g* by the operation of the movement mechanism (not illustrated in the drawings) such as a loop car. The movable rolls 4*b*, 4*d*, and 4*f* are brought into contact with the steel strip 16 extended therealong and wrapped therearound. In this state, each movable roll rotates about the roll center axis thereof as a center. Accordingly, the movable rolls 4*b*, 4*d*, and 4*f* stretch the steel strip 16 in cooperation with the fixed rolls 4*a*, 4*c*, 4*e*, and 4*g* and, at the same time, transfer the steel strip 16 in the transfer direction of the steel strip 16.

The looper 4 having the constitution mentioned above is, as illustrated in FIG. 1, arranged on the upstream side of the tandem mill 8 in the transfer direction of the steel strip 16, and to be more specific, arranged between the welding machine 3 and the meandering-movement correction device 5 to accumulate or supply the steel strip 16. Accordingly, a staying time of the steel strip 16 in the looper 4 is adjusted. The operation of accumulating or supplying the steel strip 16 by the looper 4 is performed for absorbing a transfer idle time or the like of the steel strip 16 that occurs in performing steel-sheet welding by the welding machine 3.

For example, in the cold rolling facility 1, in a period of time that elapses while the welding machine 3 does not weld the steel strip 16, the looper 4 receives the steel strip 16 from the welding machine 3 while moving the movable rolls 4*b*, 4*d*, and 4*f* in the direction away from the fixed rolls 4*a*, 4*c*, 4*e*, and 4*g*. Accordingly, the looper 4 accumulates the steel strip 16 supplied from the welding-machine 3 while transferring the steel strip 16 continuously to the tandem-mill-8 side of the transfer passage. On the other hand, in a period of time that elapses while the welding machine 3 welds the distal end portion and the tail end portion of the respective steel sheets 15, the transfer of the steel strip 16 from the welding machine 3 to the looper 4 is stopped. In this case, the looper 4 moves the movable rolls 4*b*, 4*d*, and 4*f* in the direction toward the fixed rolls 4*a*, 4*c*, 4*e*, and 4*g*. Accordingly, the looper 4 supplied the steel strip 16 being accumulated as described above to the tandem-mill-8 side of the transfer passage, and maintains the continuous transferring of the steel strip 16 from the welding-machine-3 side to the tandem-mill-8 side in the transfer passage. The looper 4 moves again, after the completion of welding the steel strip 16 by the welding machine 3, the movable rolls 4*b*, 4*d*, and 4*f* in the direction away from the fixed rolls 4*a*, 4*c*, 4*e*, and 4*g*. The looper 4 accumulates the steel strip 16 received from the welding machine 3 in this state while transferring the steel strip 16 continuously to the tandem-mill-8 side of the transfer passage. In this manner, the looper 4 maintains the continuous transferring of the steel strip 16 from the welding-machine-3 side to the tandem-mill-8 side in the transfer passage. The steel strip 16 supplied from the looper 4 is transferred sequentially to the meandering-movement correction device 5 located on the downstream side of the looper 4 in the transfer direction of the steel strip 16.

The meandering-movement correction device 5 is, as illustrated in FIG. 1, arranged on the upstream side of the heating device 7 in the transfer direction of the steel strip 16, and corrects the meandering movement of the steel strip 16 before being heated by the heating device 7. In the present embodiment, the meandering-movement correction device 5 is provided with four bridle rolls 5*a* to 5*d*, and a roll tilting unit 5*e* that tilts the bridle rolls 5*a* to 5*d*.

Each of the bridle rolls 5*a* to 5*d* has a function as a roll body that transfers the steel strip 16, and a function as a roll body for controlling a tensile force applied to the steel strip 16. To be more specific, each of the bridle rolls 5*a* to 5*d* is arranged along the transfer passage of the steel strip 16 so that a wrapping angle of the steel strip 16 is equal to or larger than a predetermined value (90 degrees or larger, for example). Here, the wrapping angle is a central angle of each of the bridle rolls 5*a* to 5*d*, the central angle corresponding to a peripheral surface part of each bridle roll, the peripheral surface part being brought into contact with the steel strip 16. Each of the bridle rolls 5*a* to 5*d* arranged in this manner rotates, while being brought into contact with the steel strip 16 extended along and wrapped around the bridle rolls 5*a* to 5*d*, about the roll center axis thereof as a center by the operation of a drive unit (not illustrated in the drawings). Accordingly, the bridle rolls 5*a* to 5*d* transfer, while applying a tensile force to the steel strip 16 by the friction force generated between the peripheral surface of each bridle roll and the steel strip 16, the steel strip 16 from the looper-4 side to the heating-device-7 side in the transfer passage.

To be more specific, the bridle roll 5*a* stretches the steel strip 16 in cooperation with the bridle roll 5*b* and, at the same time, transfers the steel strip 16 from the looper-4 side to the bridle-roll-5*b* side in the transfer passage. The bridle roll 5*b* stretches the steel strip 16 in cooperation with the bridle rolls 5*a* and 5*c* and, at the same time, transfers the steel strip 16 from the bridle-roll-5*a* side to the bridle-roll-5*c* side in the transfer passage. The bridle roll 5*c* stretches the steel strip 16 in cooperation with the bridle rolls 5*b* and 5*d* and, at the same time, transfers the steel strip 16 from the bridle-roll-5*b* side to the bridle-roll-5*d* side in the transfer passage. The bridle roll 5*d* stretches the steel strip 16 in cooperation with the bridle roll 5*c* and, at the same time, transfers the steel strip 16 from the bridle-roll-5*c* side to the heating-device-7 side in the transfer passage. As described above, the tensile force applied to the steel strip 16 by the bridle rolls 5*a* to 5*d* is controlled by adjusting a rotational speed of each of the bridle rolls 5*a* to 5*d*.

Figure 2:
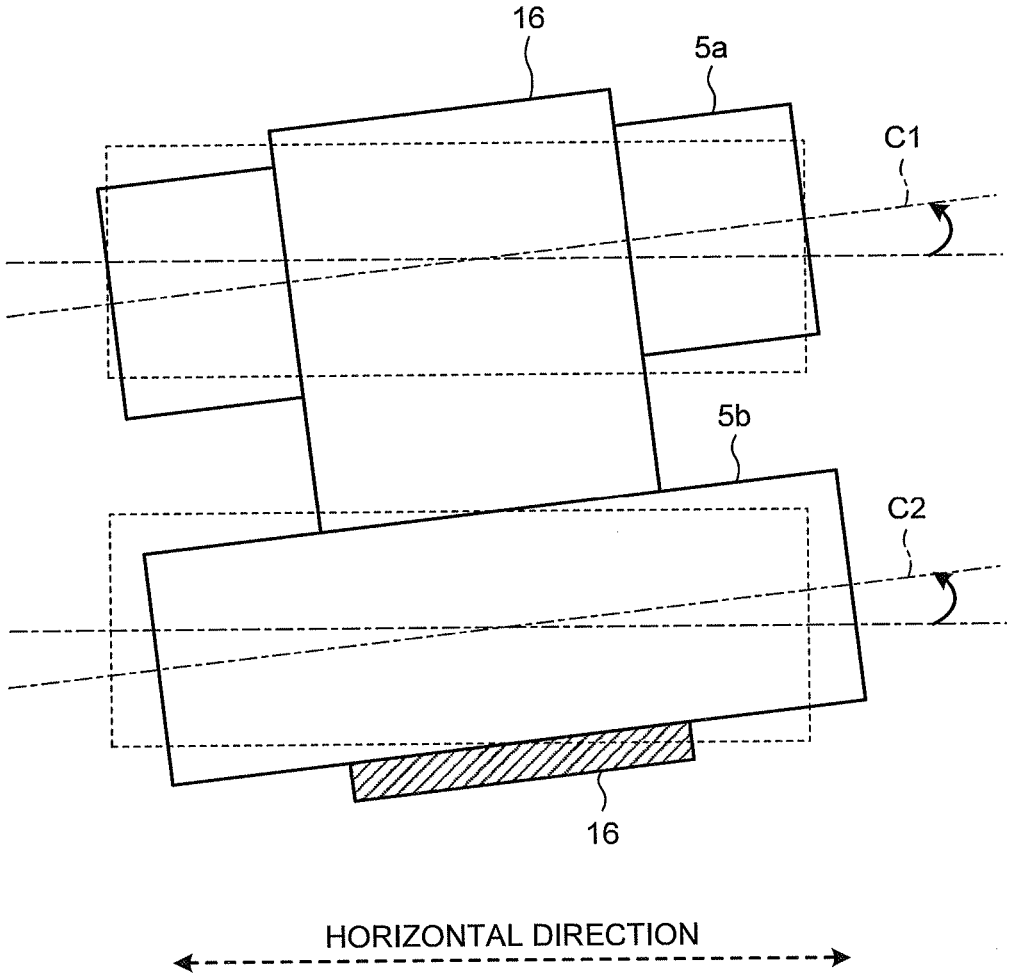
FIG. 2 is a view illustrating a state of tilting bridle rolls of a meandering-movement correction device in the present embodiment.

Furthermore, the bridle rolls 5*a* to 5*d* have a steering function capable of correcting the meandering movement of the steel strip 16. To be more specific, the bridle rolls 5*a* to 5*d* are supported by the roll tilting unit 5*e* in a state that each of the bridle rolls 5*a* to 5*d* is capable of rotating about the roll center axis thereof as a center of rotation. The roll tilting unit Se tilts the bridle rolls 5*a* to 5*d* so that the roll center axis of each of the bridle rolls 5*a* to 5*d* tilts with respect to the horizontal direction. FIG. 2 is a view illustrating a state of tilting the bridle rolls of the meandering-movement correction device in the present embodiment. The roll tilting unit 5*e* tilts, when the meandering-movement of the steel strip 16 occurs, the bridle rolls 5*a* and 5*b* so that as illustrated in FIG. 2 for example, roll center axes C1 and C2 of the respective bridle rolls 5*a* and 5*b* that stretch the steel strip 16 tilt with respect to the horizontal direction. In the present embodiment, the roll tilting unit 5*e* also tilts the bridle rolls 5*c* and 5*d* as well as the above-mentioned bridle rolls 5*a* and 5*b*. The bridle rolls 5*a* to 5*d* are constituted in a downwardly tilting manner in the direction opposite to the meandering-movement direction of the steel strip 16 by such a tilting operation that is the steering function of the roll tilting unit 5*e* thus correcting the meandering movement of the steel strip 16 before being heated by the heating device 7.

The steel strip 16 transferred from the above-mentioned meandering-movement correction device 5 is transferred sequentially to the heating device 7 arranged on the downstream side of the meandering-movement correction device 5 in the transfer direction of the steel strip 16 through the sheet width meter 6 arranged on the exit side of the meandering-movement correction device 5.

The sheet width meter 6 is a device having a function as a meandering-movement amount measuring unit that measures the meandering-movement amount of the steel strip 16 before being heated by the heating device 7 and, as illustrated in FIG. 1, arranged between the meandering-movement correction device 5 and the heating device 7. The sheet width meter 6 detects both of the edge portions of the steel strip 16 on the exit side of the meandering-movement correction device 5 to calculate the respective positions of the edge portions. Next, the sheet width meter 6 calculates the center position of the steel strip 16 in the sheet width direction based on the respective calculated positions of both of the edge portions, and calculates the difference between the center position and the center of the transfer passages of the steel strip 16 as the meandering-movement amount of the steel strip 16. Furthermore, the sheet width meter 6 calculates a sheet width of the steel strip 16 based on the respective obtained positions of both of the edge portions. The sheet width meter 6 performs, continuously or intermittently for each predetermined time, such calculation of the meandering-movement amount and the sheet width of the steel strip 16 on the exit side of the meandering-movement correction device 5. In each case, the sheet width meter 6 transmits the calculated meandering-movement amount of the steel strip 16 to the controller 13 as a measurement value of the meandering-movement amount of the steel strip 16 on the exit side of the meandering-movement correction device 5. At the same time, the sheet width meter 6 transmits the calculated sheet width of the steel strip 16 to the heating device 7 as a measurement value of the sheet width of the steel strip 16 on the exit side of the meandering-movement correction device 5.

Figure 3:
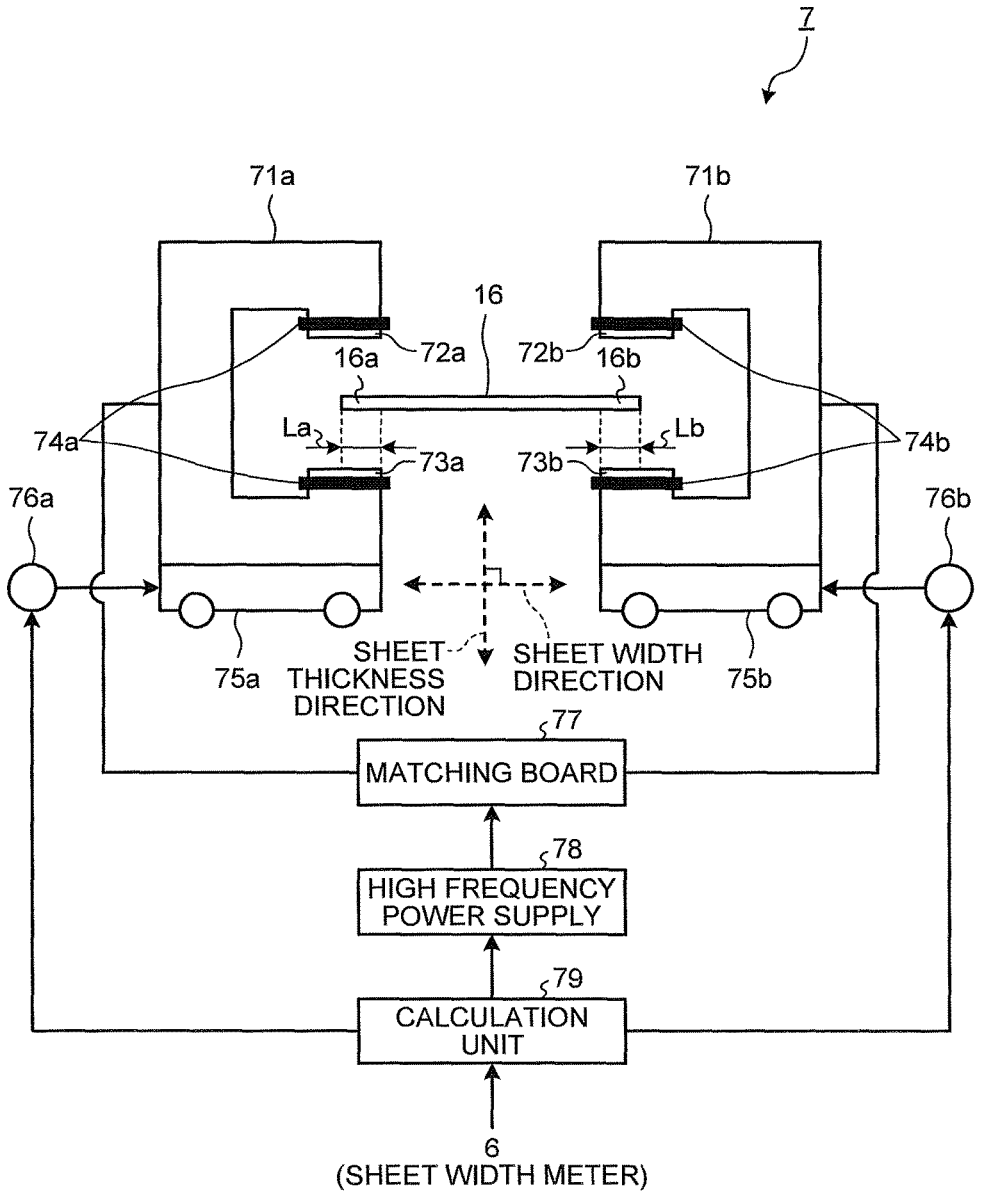
FIG. 3 is a view illustrating one configuration example of a heating device of the cold rolling facility in the present embodiment.

The heating device 7 heats the steel strip 16 transferred sequentially before the steel strip 16 is cold-rolled. In the present embodiment, the heating device 7 is, as illustrated in FIG. 1, arranged on the upstream side of the tandem mill 8 in the transfer direction of the steel strip 16. To be more specific, the heating device 7 is arranged between the sheet width meter 6 and the rolling mill 8*a* on the uppermost stream side of the tandem mill 8, and heats (induction-heats) both the edge portions of the steel strips 16 by an induction heating system. FIG. 3 is a view illustrating one configuration example of the heating device of the cold rolling facility in the present embodiment. As illustrated in FIG. 3, the heating device 7 is provided with a pair of C-shaped inductors 71*a* and 71*b* each of which is constituted so that each of the edge portions 16*a* and 16*b* in the sheet width direction of the steel strip 16 is inserted into each of the C-shaped inductors 71*a* and 71*b* in a sandwiched and spaced apart manner in the sheet thickness direction (vertically, for example) of the steel strip 16.

Each of leg portions 72*a* and 73*a* of the inductor 71*a* includes heating coils 74*a* . The heating coils 74*a* apply, when the edge portion 16*a* of the steel strip 16 passes through the inside of the space between the legs 72*a* and 73*a* of the inductor 71*a*, magnetic fluxes to the edge portion 16*a* in the sheet thickness direction to induction-heat the edge portion 16*a* . On the other hand, each of leg portions 72*b* and 73*b* of the inductor 71*b* includes heating coils 74*b*. The heating coils 74*b* apply, when the edge portion 16*b* of the steel strip 16 passes through the inside of the space between the leg portions 72*b* and 73*b* of the inductor 71*b*, magnetic fluxes to the edge portion 16*b* in the sheet thickness direction to induction-heat the edge portion 16*b*.

Furthermore, the heating device 7 is, as illustrated in FIG. 3, provided with a matching board 77, a high frequency power supply 78, and a calculation unit 79. The high frequency power supply 78 is connected to the heating coils 74*a* and 74*b* via the matching board 77. Furthermore, the calculation unit 79 is connected to the high frequency power supply 78. The calculation unit 79 sets heating conditions of the steel strip 16 based on a thickness, a transfer speed, and a steel grade of the steel strip 16, and instructs the high frequency power supply 78 to output a high frequency current to be sent to the heating coils 74*a* and 74*b* depending on the set heating conditions. The high frequency power supply 78 sends the high frequency current to the heating coils 74*a* and 74*b* via the matching board 77 based on an output instruction from the calculation unit 79 and hence, each of the heating coils 74*a* and 74*b* generates a magnetic flux (high frequency magnetic flux) in the sheet thickness direction. The high frequency magnetic flux generates an induction current in each of the edge portions 16*a* and 16*b* of the steel strip 16, and the induction current generates Joule heat in each of the edge portions 16*a* and 16*b* . Both of the edge portions 16*a* and 16*b* are induction-heated by the Joule heat generated thus being heated to the temperature higher than a ductile brittle transition temperature.

On the other hand, the heating device 7 is, as illustrated in FIG. 3, provided with carriages 75*a* and 75*b* that move the inductors 71*a* and 71*b* in the sheet width direction of the steel strip 16 respectively, and position controllers 76*a* and 76*b* that control the positions of the inductors 71*a* and 71*b* respectively. The inductor 71*a* is arranged on the carriage 75*a*, and the inductor 71*b* is arranged on the carriage 75*b*. The carriages 75*a* and 75*b* are moved in the sheet width direction of the steel strip 16 thus moving the inductors 71*a* and 71*b* in the sheet width direction of the steel strip 16 respectively. Each of the position controllers 76*a* and 76*b* connects, as illustrated in FIG. 3, the calculation unit 79 thereto. The calculation unit 79 receives the measurement value of the sheet width of the steel strip 16 from the sheet width meter 6 mentioned above, and calculates respective target positions of the inductors 71*a* and 71*b* (specifically, respective target positions of the heating coils 74*a* and 74*b*) in the sheet width direction of the steel strip 16 depending on the measurement value of the sheet width received. The calculation unit 79 transmits respectively the calculated target positions of the inductors 71*a* and 71*b* to the position controllers 76*a* and 76*b*. The position controllers 76*a* and 76*b* perform drive control of the respective carriages 75*a* and 75*b* based on the target positions of the respective inductors 71*a* and 71*b* that are received from the calculation unit 79, and control the positions of the respective inductors 71*a* and 71*b* via the drive control of the respective carriages 75*a* and 75*b*.

To be more specific, the position controller 76*a* controls the movement of the carriage 75*a* in the sheet width direction of the steel strip 16 so that the position of the inductor 71*a* and the target position corresponding to the sheet width of the steel strip 16 coincide with each other, and controls the position of the inductor 71*a* to the target position via the control of the carriage 75*a*. At the same time, the position controller 76*b* controls the movement of the carriage 75*b* in the sheet width direction of the steel strip 16 so that the position of the inductor 71*b* and the target position corresponding to the sheet width of the steel strip 16 coincide with each other, and controls the position of the inductor 71*b* to the target position via the control of the carriage 75*b*. As a result, each of the overlapping lengths La and Lb of both of the edge portions 16*a* and 16*b* of the steel strip 16 with the respective inductors 71*a* and 71*b* (refer to FIG. 3) is stationarily controlled irrespective of the change of the sheet width of the steel strip 16. In this manner, each of the overlapping lengths La and Lb being stationarily controlled assumes an optimal value for heating the edge portions 16*a* and 16*b* of the steel strip 16 to a temperature equal to or higher than the ductile brittle transition temperature.

In the present embodiment, as illustrated in FIG. 3, the overlapping length La of the edge portion 16*a* of the steel strip 16 with the inductor 71*a* is a length of overlapping the edge portion 16*a* vertically sandwiched between the leg portions 72*a* and 73*a* of the inductor 71*a* in the sheet thickness direction in a spaced apart manner with the inductor 71*a* (to be more specific, the leg portions 72*a* and 73*a*). The overlapping length Lb of the edge portion 16*b* of the steel strip 16 with the inductor 71*b* is a length of overlapping the edge portion 16*b* vertically sandwiched between the leg portions 72*b* and 73*b* of the inductor 71*b* in the sheet thickness direction in a spaced apart manner with the inductor 71*b* (to be more specific, the leg portions 72*b* and 73*b*).

The tandem mill 8 is a tandem-type rolling mill that cold-rolls continuously the steel strip 16 transferred sequentially, and has a plurality of rolling mills (four rolling mills 8*a* to 8*d* in the present embodiment) aligned in the transfer direction of the steel strip 16. The tandem mill 8 is, as illustrated in FIG. 1, arranged on the downstream side of the heating device 7 in the transfer direction of the steel strip 16. To be more specific, the tandem mill 8 is arranged between the heating device 7 and the flying shear 11, and sequentially cold-rolls the steel strip 16 after being heated by the heating device 7.

The four rolling mills 8*a* to 8*d* that constitute the tandem mill 8 are installed next to each other in the transfer direction of the steel strip 16 in this order. That is, in the tandem mill 8, the rolling mill 8*a* is located on the uppermost stream side in the transfer direction of the steel strip 16, and the rolling mill 8*d* is located on the lowermost stream side in the transfer direction of the steel strip 16. The rolling mill 8*b* is arranged subsequently to the rolling mill 8*a* located on the uppermost stream side (on the downstream side in the transfer direction of the steel strip 16). The rolling mill 8*c* is arranged between the rolling mill 8*b* and the rolling mill 8*d* located on the lowermost stream side. The steel strip 16 after being heated by the heating device 7 is transferred toward the entrance side of the tandem mill (toward the rolling mill 8*a* located on the uppermost stream side) from the exit side of the heating device 7. The tandem mill 8 receives the steel strip 16 after being heated at the rolling mill 8*a* located on the uppermost stream side and thereafter, the steel strip 16 received is continuously cold-rolled by the rolling mills 8*a* to 8*d* . Accordingly, the tandem mill 8 cold-rolls the steel strip 16 so that the thickness of the steel strip 16 assumes a predetermined target thickness. The steel strip 16 after being cold-rolled by the tandem mill 8 is transferred to the exit side of the rolling mill 8*d* located on the lowermost stream side and thereafter, transferred sequentially to the flying shear 11 through a pinch roll or the like.

Furthermore, the rolling mill 8*a* located on the uppermost stream side in the tandem mill 8 includes the shape control actuator 9. The shape control actuator 9 has a function as a shape controller that controls the shape of the steel strip 16 after being cold-rolled by the rolling mill 8*a* located on the uppermost stream side in the tandem mill 8. The shape control actuator 9 imparts deflection or inclination to a work roll 8*aa* of the rolling mill 8*a* located on the uppermost stream side by way of a back-up roll or the like thus controlling the shape of the steel strip 16 after being cold-rolled by the rolling mill 8*a* located on the uppermost stream side. Such shape control of the steel strip 16 enables the shape control actuator 9 to correct, for example, a shape of the steel strip 16 being asymmetric in the sheet width direction of the steel strip 16 after being cold-rolled to a symmetric shape. Furthermore, the shape control actuator 9 controls the shape of the steel strip 16 after being cold-rolled by the rolling mill 8*a* located on the uppermost stream side thus correcting a meandering movement of the steel strip 16 attributed to the cold rolling of the steel strip 16 by the tandem mill 8.

The shape measuring unit 10 measures the shape of the steel strip 16 before being cold-rolled by the rolling mill 8*a* located on the uppermost stream side in the tandem mill 8. To be more specific, the shape measuring unit 10 is constituted by using a roll body or the like whose peripheral surface includes a plurality of sensors that detect the stress of the steel strip 16 for each predetermined region in the sheet width direction and, as illustrated in FIG. 1, arranged on the exit side of the rolling mill 8*a* located on the uppermost stream side (between the rolling mills 8*a* and 8*b*). The shape measuring unit 10 measures tension distribution in the sheet width direction of the steel strip 16 on the exit side of the rolling mill 8*a* located on the uppermost stream side each time the roll body is once rotated about the roll center axis thereof, and measures the shape of the steel strip 16 (hereinafter, referred properly to as "steel-strip shape") on the exit side of the rolling mill 8*a* located on the uppermost stream side based on the tension distribution acquired. The shape measuring unit 10 transmits, each time the shape measuring unit 10 measures the steel-strip shape in this manner, the measurement value of the steel-strip shape acquired to the controller 13.

The flying shear 11 is, as illustrated in FIG. 1, arranged between the exit side of the tandem mill 8 and the tension reel 12, and cuts the steel strip 16 after being cold-rolled by the tandem mill 8 to a predetermined length. The tension reel 12 winds the steel strip 16 cut by the flying shear 11 in a coiled shape.

The controller 13 individually controls a meandering movement that is attributed to the shape of the steel sheet 15 serving as the base material of the steel strip 16, and occurs in the steel strip 16 on the entrance side of the heating device 7 (hereinafter, referred properly to as "meandering movement attributed to a shape of a base-material sheet); and a meandering movement that is attributed to the cold rolling of the steel strip 16 by the tandem mill 8, and occurs in the steel strip 16 on the exit side of the heating device 7 (hereinafter, referred properly to as "meandering movement attributed to a rolling operation). To be more specific, the controller 13 controls operations of the roll tilting unit 5*e* of the meandering-movement correction device 5 based on a measurement value of the meandering-movement amount of the steel strip 16 that is measured by the sheet width meter 6, and controls a tilting angle of the bridle rolls 5*a* to 5*d* in the meandering-movement correction device 5 with respect to the horizontal direction, and a tilting direction via the control of the roll tilting unit 5*e*. Accordingly, the controller 13 controls a meandering movement of the steel strip 16 before being heated by the heating device 7 (meandering movement attributed to a shape of a base-material sheet). At the same time, the controller 13 controls operations of the shape control actuator 9 based on a measurement value of the steel-strip shape that is transmitted from the shape measuring unit 10, and controls a meandering movement of the steel strip 16 that is attributed to the cold rolling of the steel strip 16 by the tandem mill 8 (meandering movement attributed to a rolling operation) via the control of the shape control actuator 9. On the other hand, the controller 13 controls a rotational speed of each of the bridle rolls 5*a* to 5*d* in the meandering-movement correction device 5 thus controlling a tensile force of the steel strip 16 applied by the bridle rolls 5*a* to 5*d*.

Method for Cold Rolling

Figure 4:
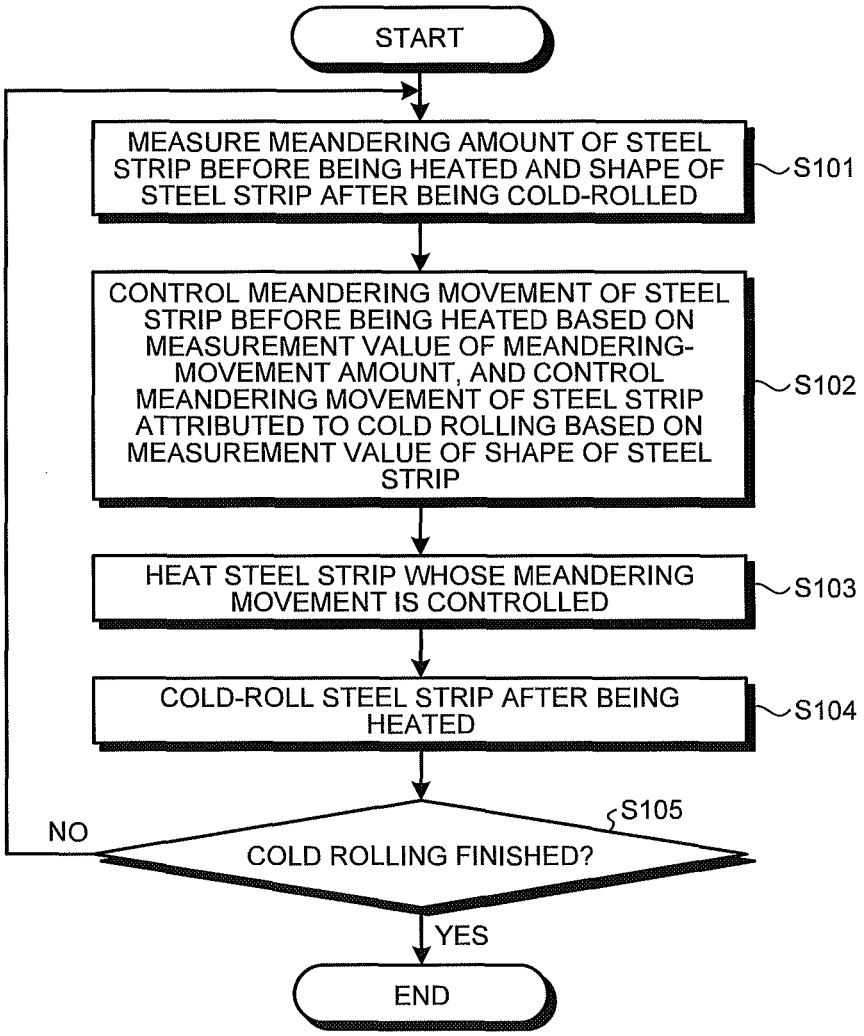
FIG. 4 is a flowchart illustrating one example of a method for cold rolling according to the present embodiment.

Next, the method for cold rolling according to the embodiment of the present invention is explained. FIG. 4 is a flowchart illustrating one example of the method for cold rolling according to the present embodiment. In the method for cold rolling according to the present embodiment, the cold rolling facility 1 illustrated in FIG. 1 performs each of processes of S101 to S105 illustrated in FIG. 4 for each steel strip 16 that is sequentially transferred toward the tension reel 12 from the exit side of the looper 4 to heat and cold-roll the steel strip 16 that is a material to be rolled.

To be more specific, as illustrated in FIG. 4, the cold rolling facility 1 first measures a meandering-movement amount of the steel strip 16 before being heated by the heating device 7, and the shape of the steel strip 16 after being cold-rolled by the rolling mill 8*a* located on the uppermost stream side in the tandem mill 8 (S101). At S101, the cold rolling facility 1 measures the meandering-movement amount of the steel strip 16 before being heated, with the use of the sheet width meter 6 arranged between the meandering-movement correction device 5 and the heating device 7 as illustrated in FIG. 1. The meandering-movement correction device 5 is, as described above, arranged on the upstream side of the heating device 7 in the transfer direction of the steel strip 16, and corrects a meandering movement of the steel strip 16 before being heated. The sheet width meter 6 measures the meandering-movement amount of the steel strip 16 transferred toward the entrance side of the heating device 7 from the exit side of the meandering-movement correction device 5, and transmits the meandering-movement amount acquired to the controller 13 as a meandering-movement amount of the steel strip 16 before being heated by the heating device 7.

Concurrently, the cold rolling facility 1 measures a shape of the steel strip 16 after being cold-rolled by the rolling mill 8*a* located on the uppermost stream side, with the use of the shape measuring unit 10 arranged on the exit side of the rolling mill 8*a* located on the uppermost stream side as illustrated in FIG. 1. In this case, the shape measuring unit 10 measures tension distribution in the sheet width direction of the steel strip 16 transferred to the exit side of the rolling mill 8*a* located on the uppermost stream side in the tandem mill 8, and measures a shape of the steel strip 16 based on the tension distribution acquired. The shape measuring unit 10 transmits the measurement value of such a steel-strip shape measured based on the tension distribution to the controller 13.

After performing S101, the cold rolling facility 1 controls a meandering movement of the steel strip 16 before being heated by the heating device 7 based on the measurement value of the meandering-movement amount of the steel strip 16 at S101 and, at the same time, controls the meandering movement attributed to the cold rolling of the steel strip 16 based on the measurement value of the steel-strip shape at S101 (S102).

At S102, the controller 13 controls the operations of the roll tilting unit 5*e* in the meandering-movement correction device 5 based on the measurement value of the meandering-movement amount of the steel strip 16 acquired from the sheet width meter 6. Accordingly, the controller 13 controls the steering function of the bridle rolls 5*a* to 5*d* in the meandering-movement correction device 5 so as to correct the meandering movement of the steel strip 16 before being heated as mentioned above; that is, the meandering movement attributed to the shape of the base-material sheet of the steel strip 16. The controller 13 controls, by way of such control of the steering function, the meandering movement attributed to the shape of the base-material sheet of the steel strip 16 on the entrance side of the heating device 7. In this manner, the meandering movement attributed to the shape of the base-material sheet of the steel strip 16 is feedback-controlled based on the meandering-movement amount of the steel strip 16 before being heated.

Furthermore, at S102, the controller 13 controls the meandering movement of the steel strip 16 attributed to the cold rolling by the tandem mill 8; that is, the controller 13 controls the meandering movement attributed to the rolling operation of the steel strip 16, in parallel to such control of the meandering movement attributed to the shape of the base-material sheet. To be more specific, the controller 13 controls, based on a measurement value of the steel-strip shape that is acquired from the shape measuring unit 10, the shape control actuator 9 of the rolling mill 8*a* located on the uppermost stream side in the tandem mill 8. In this case, the controller 13 grasps, based on the measurement value of the steel-strip shape that is acquired from the shape measuring unit 10, the tension distribution in the sheet width direction of the steel strip 16 on the exit side of the rolling mill 8*a* located on the uppermost stream side. Next, the controller 13 controls the operations of the shape control actuator 9 so that the tension distribution is in line symmetry (hereinafter, referred to as "left-and-right symmetry") in the longitudinal direction of the steel strip 16, and preferably uniform in the sheet width direction. The shape control actuator 9 adjusts, based on the control of the controller 13, a rolling reduction on each of both ends in the center axis direction of a work roll of the rolling mill 8*a* (hereinafter, referred to as "left/right rolling reduction") so that the tension distribution in the sheet width direction of the steel strip 16 is in left-and-right symmetry. Accordingly, the shape control actuator 9 corrects the steel-strip shape on the exit side of the rolling mill 8*a* located on the uppermost stream side and, at the same time, corrects the meandering movement attributed to the rolling operation of the steel strip 16. The controller 13 controls, by way of such control of the shape control actuator 9, the meandering movement attributed to the rolling operation of the steel strip 16 on the exit side of the heating device 7. In this manner, the meandering movement attributed to the rolling operation of the steel strip 16 is feedback-controlled based on the shape of the steel strip 16 after being cold-rolled by the rolling mill 8*a* located on the uppermost stream side.

After performing S102, the cold rolling facility 1 uses the heating device 7 located on the upstream side of the tandem mill 8 in the transfer direction of the steel strip 16 to heat the steel strip 16 whose meandering movement is controlled at S102 (S103). The heating device 7 is, as illustrated in FIG. 3, an induction heating-type heating device provided with the C-shaped inductors 71*a* and 71*b* that respectively insert thereinto the edge portions 16*a* and 16*b* in the sheet width direction of the steel strip 16 in a sandwiched and spaced apart manner in the sheet thickness direction. At S103, the heating device 7 induction-heats both the edge portions 16*a* and 16*b* of the steel strip 16 in a state that the meandering movement attributed to the shape of the base-material sheet and the meandering movement attributed to the rolling operation are controlled as described above.

The meandering-movement amount of the steel strip 16 when the steel strip 16 is heated by the heating device 7 is decreased to within an allowable range in the heating device 7 at S102 mentioned above. The allowable range of the meandering-movement amount is a range of the meandering-movement amount of the steel strip 16, within which each of the overlapping lengths La and Lb between the inductors 71*a* and 71*b* of the heating device 7 illustrated in FIG. 3 and the respective edge portions 16*a* and 16*b* of the steel strip 16 is capable of being controlled stationarily to, and the meandering-movement amount of the steel strip 16 assumes, for example, a zero value or a value approximated to the zero value. The heating device 7 induction-heats both the edge portions 16*a* and 16*b* of the steel strip 16 in a state that the meandering-movement amount is decreased to within such an allowable range thus increasing stably the temperature of each of the edge portions 16*a* and 16*b* to a temperature higher than the ductile brittle transition temperature.

After performing S103, the cold rolling facility 1 cold-rolls the steel strip 16 after being heated at S103 with the use of the tandem mill 8 (S104). At S104, the tandem mill 8 uses the rolling mills 8*a* , 8*b* , 8*c*, and 8*d* in this order to cold-roll continuously the steel strip 16 after being heated. The steel strip 16 after being cold-rolled at S104 is cut by the flying shear 11 illustrated in FIG. 1 and thereafter, wound by the tension reel 12 in a coiled manner.

After performing S104, the cold rolling facility 1 finishes the present process when the cold rolling process is finished over the overall length of the steel strip 16 that is a material to be rolled (Yes at S105). On the other hand, when the cold rolling of the steel strip 16 is not finished (No at S105), the cold rolling facility 1 returns the processing to S101 mentioned above, and repeats properly the processing steps from S101.

Here, the steel strip 16 is a strip-shaped steel sheet formed by joining the tail end portion of a preceding material and the distal end portion of a succeeding material in the plurality of steel sheets 15 transferred sequentially, and one example of a steel sheet as a material to be rolled in the present embodiment. Furthermore, as each steel sheet 15 that constitutes the steel strip 16, a material difficult to be rolled such as a silicon steel sheet containing 1% or more of silicon, a stainless steel sheet, or a high carbon steel sheet is used.

The steel strip 16 to be cold-rolled generally includes defects in shape such as center buckle or uneven elongation that are formed in a hot-rolled coil (hot rolled sheet steel) serving as a base material of the steel strip 16 when hot-rolling. Accordingly, in the cold rolling facility 1, when the steel strip 16 is sequentially transferred toward the heating device 7, the meandering movement attributed to the shape of a base-material sheet occurs in the steel strip 16 being transferred, by the bending moment that acts due to the tension distribution in the sheet width direction occurring depending on the shape of the steel strip 16. Assuming that the meandering-movement correction device 5 is not arranged at the preceding stage of the heating device 7, the meandering movement attributed to the shape of a base material occurs occasionally in the steel strip 16 on the entrance side of the heating device 7. Particularly, in the joint portion between respective steel sheets that constitute the steel strip 16, a rapid meandering movement attributed to the shape of a base-material sheet occurs in the steel strip 16. In this manner, when the meandering movement attributed to the shape of the base-material sheet occurs in the steel strip 16, it is difficult to induction-heat uniformly the edge portions 16*a* and 16*b* of the steel strip 16 by the heating device 7. Due to such circumstances, the underheat or the abnormal local heating of the edge portions 16*a* and 16*b* of the steel strip 16 occurs and, as a result, a steel-sheet fracture occurs while cold-rolling the steel strip 16.

On the other hand, the cold rolling facility 1 according to the present embodiment is, as illustrated in FIG. 1, provided with the meandering-movement correction device 5 at the preceding stage of the heating device 7 thus regularly correcting the meandering movement attributed to the shape of a base-material sheet of the steel strip 16 by the meandering-movement correction device 5. As a result, the meandering movement attributed to the shape of the base-material sheet of the steel strip 16 on the entrance side of the heating device 7 is prevented thus overcoming the problem such as the steel-sheet fracture mentioned above.

On the other hand, when the steel strip 16 is cold-rolled by the tandem mill 8, there exists the case that a meandering movement occurs, depending on rolling conditions, in the steel strip 16 while being cold-rolled. For example, to consider a case where the sheet thickness in the sheet-thickness profile in the sheet width direction of a hot-rolled steel sheet that is a base material of the steel strip 16 varies (a case that a sheet thickness on one end side in the sheet width direction is larger than that on the other end side in the sheet width direction, or the like), even when work rolls are parallel to each other at the pressing-down position of the work roll with respect to the steel strip 16 in the tandem mill 8, the rolling reduction of a large thickness portion in the steel strip 16 becomes large and hence, a meandering movement occurs in the steel strip 16 while being cold-rolled. Such meandering movement attributed to the rolling operation of the steel strip 16 influences a steel strip part succeeding the steel strip 16 while being cold-rolled; that is, a part of the steel strip 16 before being cold-rolled located on the entrance side of the tandem mill 8. To be more specific, the meandering movement attributed to the rolling operation of the steel strip 16 causes a meandering movement of the steel strip 16 heated by the heating device 7 located at the preceding stage of the tandem mill 8. Accordingly, the overlapping lengths La and Lb between the inductors 71*a* and 71*b* of the heating device 7 and the respective edge portions 16*a* and 16*b* of the steel strip 16 (refer to FIG. 3) change due to the meandering movement attributed to the rolling operation of the steel strip 16. As a result, the underheat or the abnormal local heating of the edge portions 16*a* and 16*b* of the steel strip 16 occurs, and consequently leads to the steel-sheet fracture of the steel strip 16 while being cold-rolled.

Here, the meandering-movement correction device 5 mentioned above is a device that corrects the meandering movement of the steel strip 16 by the steering function of the bridle rolls 5*a* to 5*d*. The meandering movement of the steel strip 16 corrected by the meandering-movement correction device 5 is a meandering movement attributed to the shape of a base material, and different in occurrence cause from the meandering movement that is attributed to the rolling operation of the steel strip 16, and occurs in the tandem mill 8. Therefore, it is difficult to correct simultaneously and stably the meandering movement attributed to the shape of a base material of the steel strip 16 while being transferred toward the heating device 7, and the meandering movement attributed to the rolling operation of the steel strip 16 on the exit side of the heating device 7 by the meandering-movement correction device 5.

Furthermore, the meandering movement attributed to the rolling operation of the steel strip 16 is generally controlled by measuring a rolling load that acts on each of left-and-right pressing-down cylinders when the steel strip 16 is cold-rolled, and adjusting left-and-right rolling reductions in proportion to the difference between the left-and-right rolling loads measured. However, when both the edge portions 16*a* and 16*b* of the steel strip 16 are heated by the heating device 7 located at the preceding stage of the tandem mill 8 as described above, a deformation resistance of the steel strip 16 changes in the sheet width direction. Hence, there exists the possibility that the change of each of the overlapping lengths La and Lb or the like illustrated in FIG. 3 changes the temperature of each of the edge portions 16*a* and 16*b* of the steel strip 16. In this case, even when the left-and-right rolling loads in cold-rolling the steel strip 16 are identical with each other, the rolling reduction on the right side (edge-portion-16*a* side) of the steel strip 16 and the rolling reduction on the left side (edge-portion-16*b* side) of the steel strip 16 are different from each other. As a result, a meandering movement attributed to a rolling operation occurs in the steel strip 16.

On the other hand, the cold rolling facility 1 according to the present embodiment is, as illustrated in FIG. 1, provided with the shape control actuator 9 in the rolling mill 8*a* located on the uppermost stream side in the tandem mill 8, and controls the meandering movement attributed to the rolling operation of the steel strip 16 by using the shape control actuator 9. To be more specific, the cold rolling facility 1 directly measures the steel-strip shape on the exit side of the rolling mill 8*a* located on the uppermost stream side, and controls the shape control actuator 9 to adjust the left-and-right rolling reductions of the rolling mill 8*a* based on the measurement value of the steel-strip shape thus correcting the meandering movement attributed to the rolling operation of the steel strip 16 on the exit side of the heating device 7. Accordingly, it is possible to constantly eliminate, irrespective of whether the deformation resistance of the steel strip 16 changes in the sheet width direction, the influence of the meandering movement attributed to the rolling operation of the steel strip 16 upon the steel strip 16 in the heating device 7. Accordingly, the overlapping lengths La and Lb in the heating device 7 no more change due to causes other than the change of the sheet width of the steel strip 16 thus achieving stable heating of both the edge portions 16*a* and 16*b* of the steel strip 16 by the heating device 7. As a result, it is possible to overcome such problems as the steel-sheet fracture mentioned above.

EXAMPLE

Next, an example of the present invention is explained. In the present example, the cold rolling facility 1 illustrated in FIG. 1 joined the distal end portion and the tail end portion of the respective steel sheets 15 whose content of silicon is 3.0% or more by using the welding machine 3 to form the steel strip 16, heated both the edge portions 16*a* and 16*b* of the steel strip 16 by using the heating device 7, and continuously cold-rolled the steel strip 16 after being heated by using the tandem mill 8. In this case, the heating condition of the steel strip 16 by the heating device 7 was set so that both the edge portions 16*a* and 16*b* of the steel strip 16 immediately before being entered into the tandem mill 8 are surely heated to a temperature of 60° C. or higher. Furthermore, the cold rolling facility 1 corrected a meandering movement attributed to the shape of a base-material sheet of the steel strip 16 by using the steering function of the meandering-movement correction device 5 and, at the same time, controlled the shape control actuator 9 based on a steel-strip shape measured on the exit side of the rolling mill 8*a* located on the uppermost stream side in the tandem mill 8 to correct the meandering movement attributed to the rolling operation of the steel strip 16. The cold rolling facility 1 heated both the edge portions 16*a* and 16*b* of the steel strip 16 by using heating device 7, while maintaining the above-mentioned state in which the meandering movement is corrected.

Furthermore, in comparative examples 1 and 2 with respect to the present example, the cold rolling facility 1 changed the setting conditions of the meandering-movement correction device 5, the heating device 7, and the shape control actuator 9, and cold-rolled the steel strip 16. To be more specific, in the comparative example 1, while the cold rolling facility 1 enabled a meandering correction function of the steel strip 16 in the meandering-movement correction device 5 mentioned above, the cold rolling facility 1 disabled the control of the shape control actuator 9 based on the measurement value of the steel-strip shape on the exit side of the rolling mill 8*a* located on the uppermost stream side so as not to control the meandering movement attributed to the rolling operation of the steel strip 16. The cold rolling facility 1 heated, while maintaining this state, both the edge portions 16*a* and 16*b* of the steel strip 16 by using the heating device 7. On the other hand, in the comparative example 2, the cold rolling facility 1 disabled both of the meandering correction function of the steel strip 16 in the meandering-movement correction device 5 and a shape correction function (meandering correction function) of the steel strip 16 in the shape control actuator 9. The cold rolling facility 1 heated, while maintaining this state, both the edge portions 16*a* and 16*b* of the steel strip 16 by using the heating device 7. Here, the other conditions in the comparative examples 1 and 2 were set identical with those in the present example.

In each of the present example and the comparative examples 1 and 2, the steel strips 16 of 500 coils were cold-rolled, and a fracture occurrence rate of the steel strip 16 cold-rolled was examined. The results of examinations are illustrated in Table 1.

TABLE 1

| | Fracture occurrence rate of steel strip (%) |
|---|---|
| Example | 0.2 |
| Comparative example 1 | 0.8 |
| Comparative example 2 | 1.4 |

As illustrated in Table 1, the fracture occurrence rate of the steel strip 16 in the present example assumed 0.2% that is a lower value compared with the fracture occurrence rate (=0.8%) of the steel strip 16 in the comparative example 1 and the fracture occurrence rate (=1.4%) of the steel strip 16 in the comparative example 2. Particularly, the results of the examinations have indicated that the fracture occurrence rate of the steel strip 16 in the present example is decreased to one seventh that of the comparative examples 2 in which the meandering correction function of the steel strip 16 in the meandering-movement correction device 5, and the meandering correction function of the steel strip 16 in the shape control actuator 9 were disabled. This means that a synergetic effect of the function of correcting the meandering movement attributed to the shape of the base-material sheet of the steel strip 16 on the entrance side of the heating device 7 by the steering function of the meandering-movement correction device 5, and the function of correcting the meandering movement attributed to the rolling operation of the steel strip 16 on the exit side of the heating device 7 by the shape control actuator 9 results in the stationary control of the overlapping lengths La and Lb between the heating device 7 and steel strip 16 thus ensuring the temperature of each of the edge portions 16*a* and 16*b* of the steel strip 16 equal to or higher than the ductile brittle transition temperature to cold-roll the steel strip 16.

That is, correcting the meandering movement attributed to the shape of the base-material sheet of the steel strip 16 on the entrance side of the heating device 7, and concurrently correcting the meandering movement attributed to the rolling operation of the steel strip 16 on the exit side of the heating device 7 are extremely effective in stationarily controlling the overlapping lengths La and Lb between the heating device 7 and the steel strip 16 to heat stably both the edge portions 16*a* and 16*b* of the steel strip 16. Furthermore, these operations are extremely effective in preventing the underheat and the abnormal local heating of both the edge portions 16*a* and 16*b* to decrease the occurrence of the steel-sheet fractures (the fracture attributed to edge cracks, the drawing fracture attributed to edge waves, or the like) when cold-rolling the steel strip 16.

As explained heretofore, in the embodiment of the present invention, the meandering-movement amount of a steel strip on the entrance side of a heating device arranged at the preceding stage of a tandem mill that cold-rolls the steel strip transferred sequentially is measured to control the meandering movement of the steel strip before being heated by the heating device based on the measurement value of the meandering-movement amount acquired and, at the same time, the shape of the steel strip after being cold-rolled by the rolling mill on the uppermost stream side in the tandem mill is measured to control the meandering movement attributed to the rolling operation of the steel strip based on the measurement value of the steel-strip shape acquired.

Accordingly, it is possible to control both the meandering movement attributed to the shape of the base-material sheet that occurs in the steel strip on the entrance side of the heating device, and the meandering movement attributed to the rolling operation that occurs in the steel strip on the exit side of the heating device. Accordingly, it is possible to correct the meandering-movement amount of the steel strip on the entrance side of the heating device to a value within the allowable range with respect to the heating device and, at the same time, to eliminate the influence of the meandering movement attributed to the rolling operation of the steel strip upon the steel strip passing through the heating device. As a result, it is possible to stationarily control the overlapping length between the heating device and the steel strip to an optimal value for cold rolling the steel strip in the period of heating the steel strip by the heating device thus stably heating both the edge portions of the steel strip to a temperature equal to or higher than the ductile brittle transition temperature. Accordingly, it is possible to suppress the occurrence of the steel-sheet fracture attributed to the underheat (edge crack) or the abnormal local heating (edge wave) of both the edge portions of the steel strip as much as possible to achieve the stable cold rolling of the steel strip.

The cold rolling facility and the method for cold rolling according to the present invention are used not only for a general steel sheet but also for any types of materials to be rolled, such as a silicon steel sheet that is a material difficult to be rolled, or a strip-shaped steel sheet (steel strip) having a joint portion between a precedence material and a succeeding material thus suppressing both the meandering movement of a material to be rolled that occurs due to the rapid change of the shape of the material to be rolled or the change of a roll crown, and the meandering movement of the material to be rolled that occurs due to the cold rolling. Since a meandering-movement suppression action of the material to be rolled is performed on the entrance side and the exit side of the heating device, the overlapping length of the material to be rolled in the heating device is stationarily controlled to an optimal value thus heating stably both the edge portions of the material to be rolled to a target temperature. As a result, it is possible to avoid both a situation in which a fracture occurs in the material to be rolled while being cold-rolled, due to the edge cracks attributed to the underheat of the edge portion, and a situation in which a drawing fracture occurs in the material to be rolled while being cold-rolled, due to the edge wave attributed to the abnormal .local heating of the edge portion thus improving the operation efficiency and the production efficiency of the cold rolling.

Here, in the embodiment mentioned above, although the cold rolling facility constituted of the completely continuous cold tandem mill in which the steel sheets supplied from the coil are continuously cold-rolled and thereafter, wound in a coiled shape is exemplified, the present invention is not limited to this example. The cold rolling facility according to the present invention may be an apparatus constituted of a tandem mill other than the completely continuous cold tandem mill, such as a continuous tandem mill arranged subsequently to a pickling line.

Furthermore, in the embodiment mentioned above, although the tandem mill constituted of four rolling mills arranged next to each other in the transfer direction of the steel strip is used, the present invention is not limited to this example. That is, in the present invention, any number of rolling mills (any number of roll stands) in the cold rolling facility, and any number of roll stages may be applicable.

Furthermore, in the embodiment mentioned above, although the steel strip is exemplified as one example of the material to be rolled, the present invention is not limited to this example. The cold rolling facility and the method for cold rolling according to the present invention are applicable to any of a general steel sheet, a strip-shaped steel sheet (steel strip) composed of a plurality of steel sheets joined to each other, and a material difficult to be rolled such as a silicon steel sheet. That is, in the present invention, any of a steel grade, a joint state, and a shape of the steel sheet as a material to be rolled may be applicable.

Furthermore, in the embodiment mentioned above, although the meandering-movement correction device provided with four bridle rolls is exemplified, the present invention is not limited to this example. The meandering-movement correction device of the cold rolling facility according to the present invention may be a device capable of correcting the meandering movement of the material to be rolled by the steering function of a roll body. In this case, the roll body of the meandering-movement correction device is not limited to the bridle roll, and may be a steering roll. In addition, the number of roll bodies arranged in the meandering-movement correction device is not limited to four, and a plurality of roll bodies may be applicable.

Furthermore, in the embodiment mentioned above, although the shape control actuator is provided to the rolling mill located on the uppermost stream side out of the plurality of rolling mills that constitute a tandem mill, the present invention is not limited to this example. Out of the rolling mills that constitute the tandem mill of the cold rolling facility according to the present invention, the rolling mills except the rolling mill located on the uppermost stream side (the rolling mills 8*b* to 8*d* illustrated in FIG. 1, for example) may be provided with respective shape control actuators similar to the shape control actuator provided to the rolling mill located on the uppermost stream side. In this case, the respective shape control actuators of the rolling mills may be controlled separately based on the measurement value of the steel-strip shape on the exit side of each rolling mill.

Furthermore, the present invention is not limited to the embodiment and the example that are mentioned above, and the present invention includes a case of constituting the above-mentioned respective constitutional features arbitrarily by combining with each other. In addition, various modifications, applications, or the like made by those skilled in the art based on the embodiment mentioned above are arbitrarily conceivable without departing from the gist of the present invention.

As mentioned above, the cold rolling facility and the method for cold rolling according to the present invention are useful for the cold rolling of the steel sheet, and particularly suitable for suppressing the occurrence of steel-sheet fractures as much as possible, and cold-rolling a steel sheet stably.

REFERENCE SIGNS LIST

1 cold rolling facility
2 uncoiler
3 welding machine
4 looper
4*a*, 4*c*, 4*e*, 4*g* fixed roll
4*b*, 4*d*, 4*f* movable roll
5 meandering-movement correction device
5*a* to 5*d* bridle roll
5*e* roll tilting unit
6 sheet width meter
7 heating device
8 tandem mill
8*a* to 8*d* rolling mill
8*aa* work roll
9 shape control actuator
10 shape measuring unit
11 flying shear
12 tension reel
13 controller
15 steel sheet
16 steel strip
16*a*, 16*b* edge portion
71*a*, 71*b* inductor
72*a*, 72*b*, 73*a*, 73*b* leg portion
74*a*, 74*b* heating coil
75*a*, 75*b* carriage
76*a*, 76*b* position controller
77 matching board
78 high frequency power supply
79 calculation unit
C1, C2 roll center axis

The invention claimed is:

1. A cold rolling facility comprising:

a heater configured to heat sequentially-transferred steel sheets;

a tandem mill including a plurality of roiling mills aligned In a transfer direction of the steel sheets and configured to sequentially cold-roll the heated steel sheets;

a meandering-amount measuring unit including a sheet width meter, configured to measure a meandering amount of each of the steel sheets before being heated by the heater, by detecting both of the edge portions of the steel strip, calculating a center position of the steel strip in the sheet width direction based on both of the edge portions of the steel strip, and calculating the difference between the center position of the steel strip and a center of a transfer passage of the steel strip;

a meandering-movement correction device including: a plurality of bridle rolls arranged along the transfer direction of the steel sheets such that a wrapping angle of the steel sheets is equal to or larger than a predetermined angle; and a tilting mechanism configured to tilt a roll center axis of each bridle roll with respect to a horizontal direction, the meandering-moving correction device being configured to correct meandering movement of the steel sheet before being heated;

a shape measuring unit including a plurality of sensors arranged on a peripheral surface of a roll body, the shape measuring unit being configured to measure the shape of the steel sheet after being cold-rolled by the rolling mill located on an uppermost stream side in the tandem mill; and shape controller including an actuator that imparts deflection or inclination to a work roll, the shape controller being configured to the shape of the steel sheet after being cold-rolled by the rolling mill located on the uppermost stream side.

2. The cold rolling facility according to claim 1, wherein the meandering-movement correction device is located on the upstream side of the heater in the transfer direction of the steel sheets, and the meandering-amount measuring unit is located between the meandering-movement correction device and the heater.

3. The cold rolling facility according to claim 2, wherein the heater includes:

C-shaped inductors each of which inserts thereinto respective edge portions in a width direction of the steel sheet in a sandwiched and spaced apart manner in a thickness direction of the steel sheet, wherein the heater heats both the edge portions of the steel sheet by induction heating.

4. The cold rolling facility according to claim 1, wherein the heater includes:

C-shaped inductors each of which inserts thereinto respective edge portions in a width direction of the steel sheet in a sandwiched and spaced apart manner in a thickness direction of the steel sheet, wherein the heater heats both the edge portions of the steel sheet by induction heating.

* * * * *